US006335592B1

(12) United States Patent
Jang et al.

(10) Patent No.: US 6,335,592 B1
(45) Date of Patent: Jan. 1, 2002

(54) PLASMA DISPLAY PANEL WITH SPECIFIC ELECTRODE STRUCTURES

(75) Inventors: Sung Ho Jang, Taegu-Kwangyok-shi; Seung Tae Park, Kyongsangbuk-do; Sang Tae Kim, Taegu-Kwangyok-shi, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/427,304

(22) Filed: Oct. 26, 1999

(30) Foreign Application Priority Data

Oct. 28, 1998 (KR) ..... 98/45524

(51) Int. Cl.[7] ..... H01J 17/49
(52) U.S. Cl. ..... 313/582; 313/584
(58) Field of Search ..... 313/582, 584, 313/586, 606, 631

(56) References Cited

FOREIGN PATENT DOCUMENTS

| | | |
|---|---|---|
| EP | 0 932 181 A2 | 7/1999 |
| JP | 3-233829 | 10/1991 |
| JP | 8-22772 | 1/1996 |
| JP | 10-173386 | 6/1998 |
| JP | 11-213894 | 8/1999 |

*Primary Examiner*—Vip Patel
(74) *Attorney, Agent, or Firm*—Fleshner & Kim, LLP

(57) ABSTRACT

A plasma display panel prevents error discharge from occurring between adjacent cells to display a clear color image on a screen. The plasma display panel includes a plurality of first sustain electrode lines successively formed on a substrate at a predetermined interval, a plurality of second sustain electrode lines coupled with each of the first sustain electrode lines one by one, a plurality of first discharge electrode pieces branched from each of the first sustain electrode lines, and a plurality of second discharge electrode pieces branched from each of the second sustain electrode lines, having discharge cells coupled with the first discharge electrode pieces.

12 Claims, 8 Drawing Sheets

PLASMA DISPLAY PANEL WITH SPECIFIC ELECTRODE STRUCTURES

BACKGROUND OF THE INVENTION

1. Field of the Invention

The present invention relates to a plasma display panel, and more particularly, to a structure of a discharge electrode for a plasma display panel.

2. Background of the Related Art

Generally, a plasma display panel and a liquid crystal display (LCD) have lately attracted considerable attention as the most practical next display of panel displays. In particular, the plasma display panel has higher luminance and wider visible angle than the LCD. For this reason, the plasma display panel is widely used as a thin type large display such as an outdoor advertising tower, a wall TV, and a theater display.

FIG. 1*a* shows a structure of a related art plasma display panel of three-electrode area discharge type. As shown in FIG. 1*a*, the plasma display panel of three-electrode area discharge type includes an upper substrate 10 and a lower substrate 20 which are bonded opposite to each other. FIG. 1*b* shows a sectional structure of the plasma display panel of FIG. 1*a*, in which the lower substrate 20 is rotated by 90°.

The upper substrate 10 includes scan electrodes 16 and 16', sustain electrodes 17 and 17', a dielectric layer 11, and a passivation film 12. The scan electrodes 16 and 16' are formed parallel to the sustain electrodes 17 and 17'. The dielectric layer 11 is deposited on the scan electrodes 16 and 16' and the sustain electrodes 17 and 17'.

The lower substrate 20 includes an address electrode 22 formed, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and the dielectric film 21. Inert gases such as He and Xe are mixed at a pressure of 400 to 500 Torr in a space between the upper substrate 10 and the lower substrate 20. The space is used as a discharge region.

In general, a mixing gas of He—Xe is used as the inert gas filled in a discharge region of a DC plasma display panel while a mixing gas of Ne—Xe is used as the inert gas filled in a discharge region of an AC plasma display panel.

The scan electrodes 16 and 16' and the sustain electrodes 17 and 17' include discharge electrodes 16 and 17 and bus electrodes 16' and 17' of metal so as to increase optical transmitivity, as shown in FIGS. 2*a* and 2*b*. FIG. 2*a* is a plane view of the sustain electrodes 17 and 17' and the scan electrodes 16 and 16' and FIG. 2*b* is a sectional view thereof.

A discharge voltage is applied to the bus electrodes 16' and 17' from an externally provided driving integrated circuit(IC). The discharge voltage is transferred to the discharge electrodes 16 and 17 to generate discharge between the adjacent discharge electrodes 16 and 17. The discharge electrodes 16 and 17 have an overall width of about 300 $\mu$m and are made of indium oxide or tin oxide. The bus electrodes 16' and 17' are formed of three-layered thin film of Cr—Cu—Cr. At this time, the bus electrodes 16' and 17' have a line width of ⅓ of a line width of the discharge electrodes 16 and 17.

FIG. 3 is a wiring diagram of scan electrodes ($S_{m-1}$, $S_m$, $S_{m+1}$, . . . , $S_{n-1}$, $S_n$, $S_{n+1}$) and sustain electrodes ($C_{m-1}$, $C_m$, $C_{m+1}$, . . . , $C_{n-1}$, $C_n$, $C_{n+1}$). In FIG. 3, the scan electrodes are insulated from one another while the sustain electrodes are connected in parallel. Particularly, a block indicated by a dotted line in FIG. 3 shows an effective area in which an image is displayed and the other blocks show ineffective areas in which an image is not displayed. The scan electrodes arranged in the ineffective areas are generally called dummy electrodes 26. The number of the dummy electrodes 26 are not specially limited.

The operation of the related art AC plasma display panel of three-electrode area discharge type will be described with reference to FIGS. 4*a* to 4*d*.

If a driving voltage is applied between the address electrodes and the scan electrodes, opposite discharge occurs between the address electrodes and the scan electrodes as shown in FIG. 4*a*. The inert gas implanted into the cell is instantaneously excited by the opposite discharge. If the inert gas is again transited to the ground state, ions are generated. The generated ions or some electrons of quasi-excited state come into collision with a surface of the passivation film as shown in FIG. 4*b*. Electrons are secondarily discharged from the surface of the passivation film by the collision of the electrons. The secondarily discharged electrons come into collision with gas of plasma state to diffuse the discharge. If the opposite discharge between the address electrodes and the scan electrodes ends, wall charges having opposite polarities occur on the surface of the passivation film on the respective address electrodes and the scan electrodes.

If the discharge voltages having opposite polarities are continuously applied to the scan electrodes and the sustain electrodes and at the same time the driving voltage applied to the address electrodes is cut off, area discharge occurs in a discharge region on the surfaces of the dielectric layer and the passivation film due to potential difference between the scan electrodes and the sustain electrodes as shown in FIG. 4*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrodes and the isolation wall so that the phosphors are excited. The excited phosphors generate visible light rays, and the visible light rays display an image on a screen.

One pixel includes a discharge cell having a red phosphor, a discharge cell having a green phosphor, and a discharge cell having a blue phosphor. The plasma display panel displays contrast of an image by controlling the number of discharges in each discharge cell.

The related art plasma display panel has several problems. FIG. 5 shows error discharge which may occur in the related art plasma display panel.

In the related art plasma display panel, since discharge electrodes 25" and 26" of Y and Z electrodes which generate area discharge are connected with all of discharge cells, wall charge may flow to its adjacent discharge cell. Thus, in spite of the fact that the adjacent cell of the discharged cell does not require discharge, error discharge 50 may occur in the adjacent cell due to wall charge from the discharged cell. In addition, error discharge 50' may occur between sustain electrodes of other adjacent discharge cell. As a result, the related art plasma display panel may display a discolored image on the screen.

SUMMARY OF THE INVENTION

Accordingly, the present invention is directed to a plasma display panel that substantially obviates one or more of the problems due to limitations and disadvantages of the related art.

An object of the present invention is to provide a plasma display panel which prevents error discharge from occurring between adjacent cells to display a clear color image on a screen.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel includes a plurality of first sustain electrode lines successively formed on a substrate at a predetermined interval, a plurality of second sustain electrode lines coupled with each of the first sustain electrode lines one by one, a plurality of first discharge electrode pieces branched from each of the first sustain electrode lines, and a plurality of second discharge electrode pieces branched from each of the second sustain electrode lines, having discharge cells coupled with the first discharge electrode pieces.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a farther understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plasma display panel according to the present invention will be described with reference to FIG. 6.

Figure 1A:
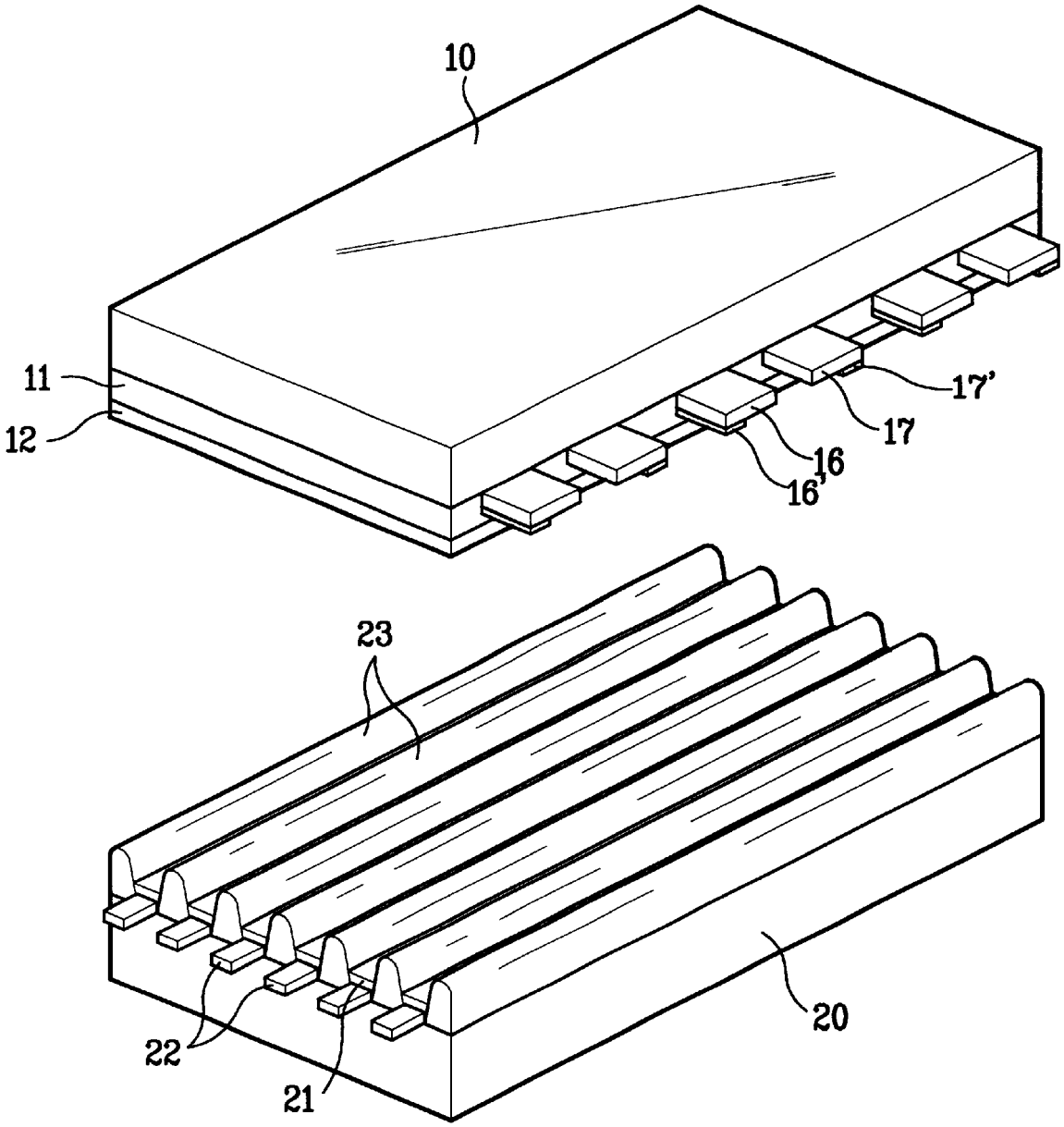
FIG.1A Background Art
FIGS. 1*a* and 1*b* show a structure of a related art plasma display panel.
Figure 1B:
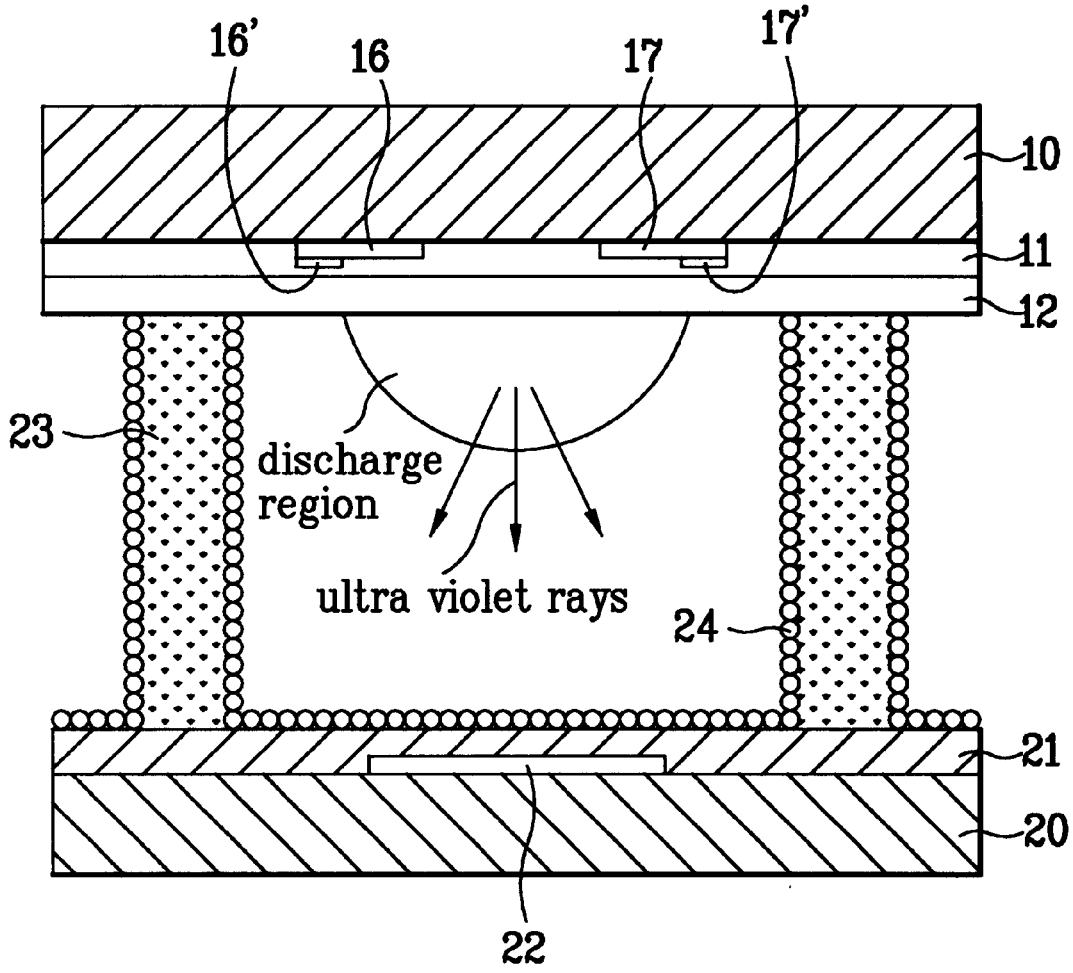
FIG.1B Background Art
Figure 2A:
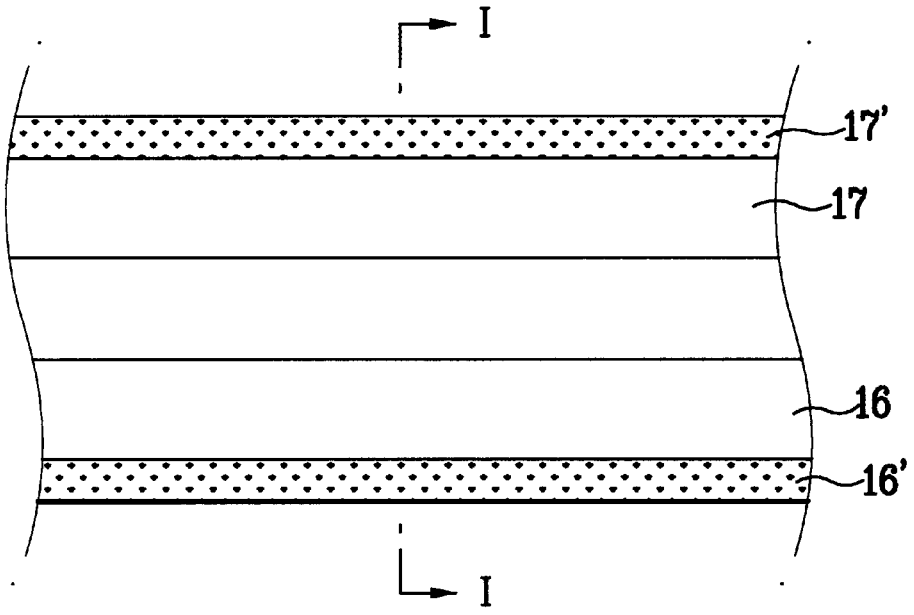
FIG.2A Background Art
FIGS. 2*a* and 2*b* show a structure of scan electrodes and sustain electrodes of a related art plasma display panel.
Figure 2B:
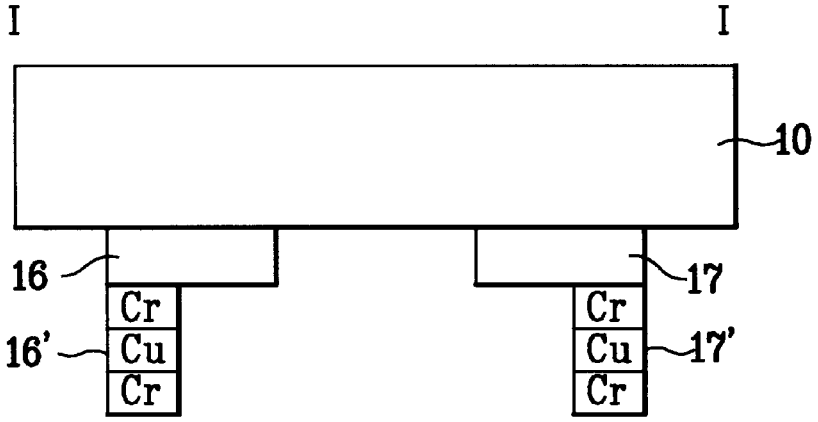
FIG.2B Background Art
Figure 3:
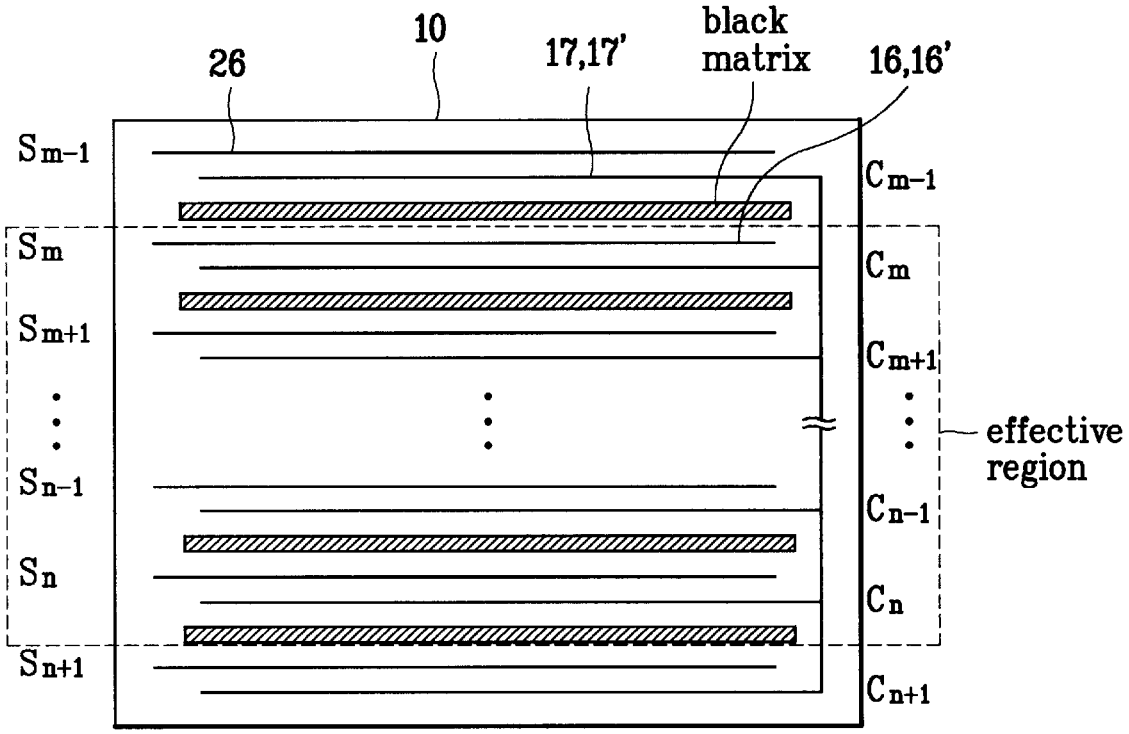
FIG.3 Background Art
FIG. 3 shows scan electrode lines and sustain electrode lines of a related art plasma display panel.
Figure 4A:
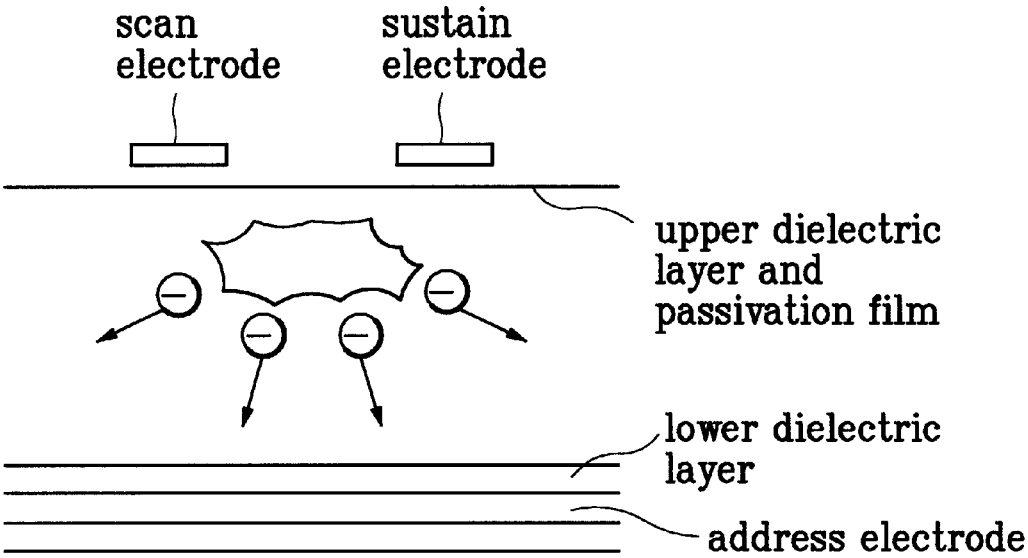
FIG. 4A Background Art
FIGS. 4*a* to 4*d* show discharge principle of a related art plasma display panel.
Figure 4B:
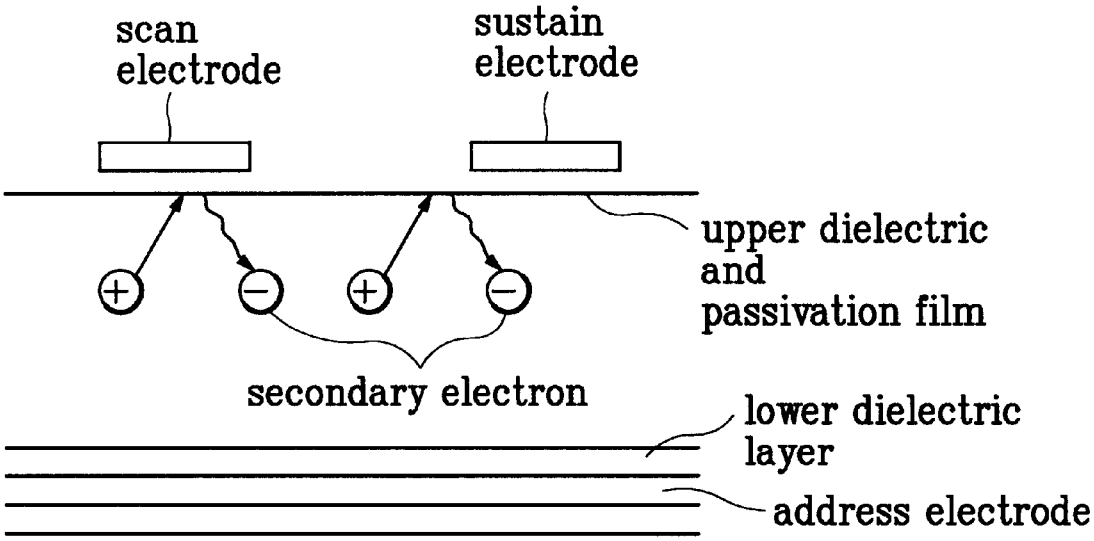
FIG. 4B Background Art
Figure 4C:
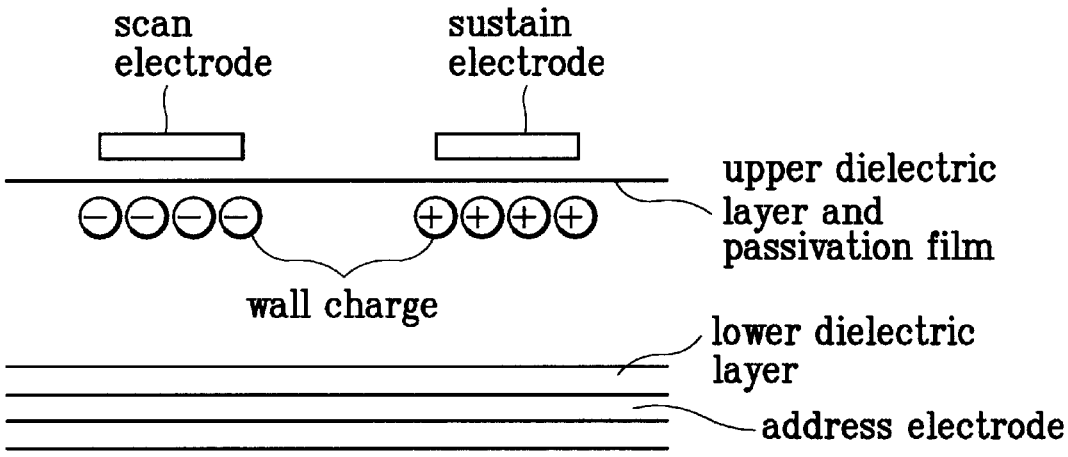
FIG. 4C Background Art
Figure 4D:
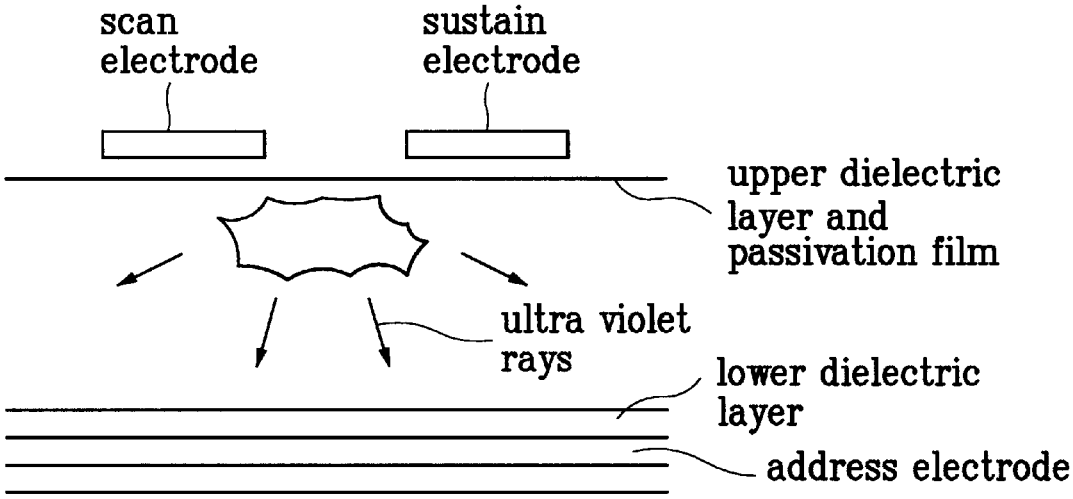
FIG. 4D Background Art
Figure 5:
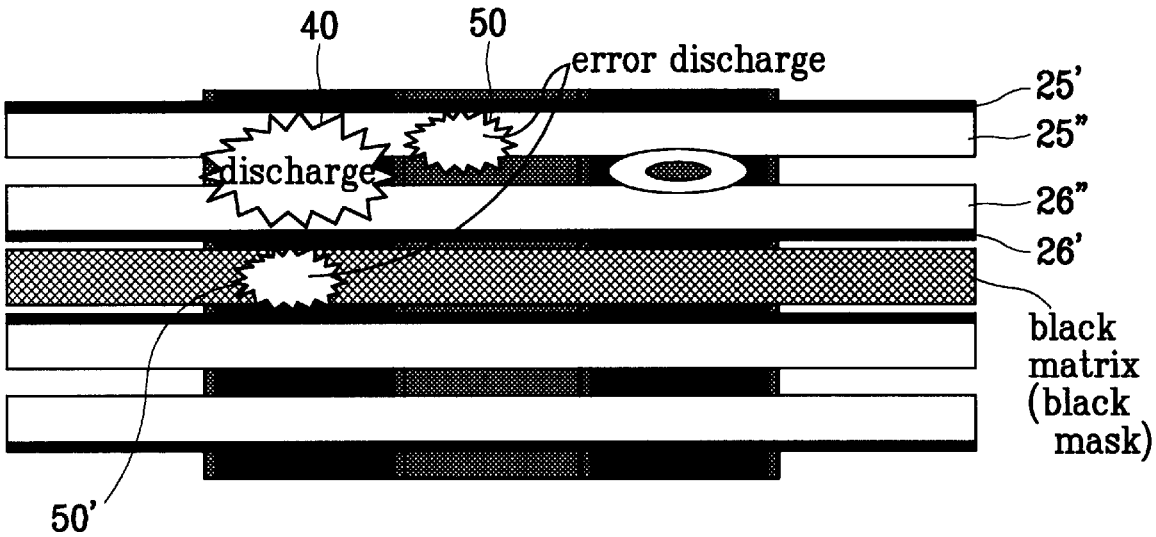
FIG. 5 shows error discharge which may occur in a related art plasma display panel.
Figure 6:
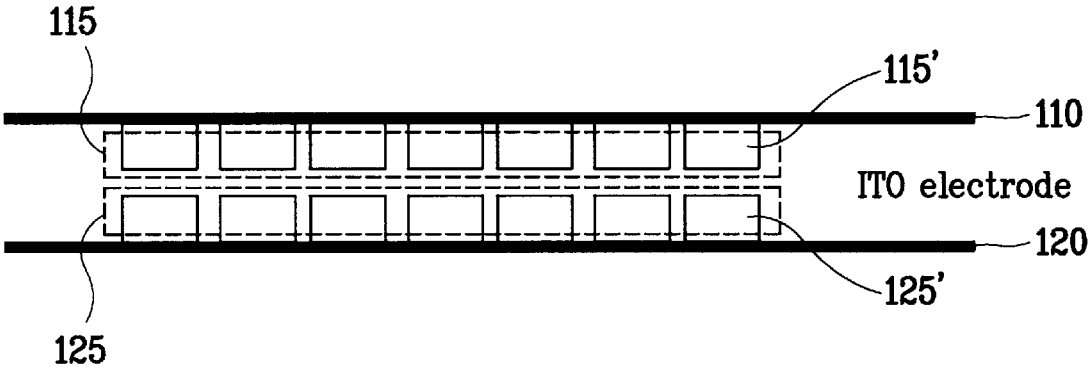
FIG. 6 is a plane view showing sustain electrode lines and discharge electrode pieces of a plasma display panel according to the present invention.
Figure 7:
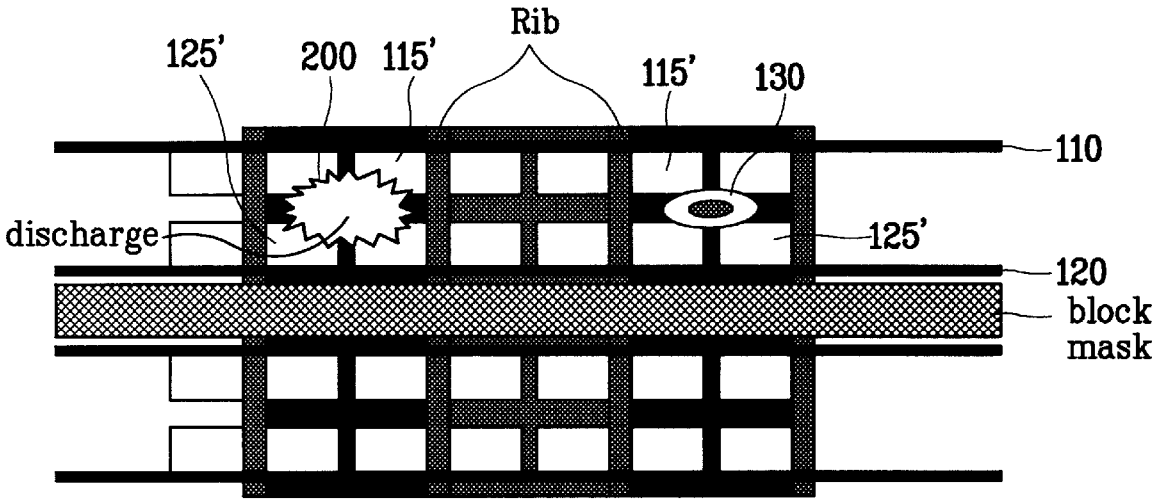
FIG. 7 shows the discharge operation of a plasma display panel according to the present invention, in which sustain electrode lines and discharge electrodes of FIG. 6 are formed.

As shown in FIG. 6, first sustain electrode lines 110 are successively formed on a substrate at a predetermined interval. A first sustain discharge voltage is applied to the first sustain electrode lines 110 from an externally provided driving IC. Second sustain electrode lines 120 are formed adjacent to the first sustain electrode lines 110 to couple with the first sustain electrode lines 110 one by one.

The first sustain electrode lines 110 and the second sustain electrode lines 120 are all made of metal materials having lower resistance than discharge electrode pieces. The first sustain electrode lines 110 and the second sustain electrode lines 120 are generally formed of a three-layered metal film of Cr and Cu.

A first discharge electrode 115 is formed branched from the first sustain electrode lines 110 at a predetermined interval. A second discharge electrode 125 is formed branched from the second sustain electrode lines 120 at a predetermined interval. In other words, the first discharge electrode 115 includes a plurality of electrode pieces 115' branched from the first sustain electrode lines 110, and the second discharge electrode 125 includes a plurality of electrode pieces 125' branched from the second sustain electrode lines 120. The first discharge electrode pieces 115' and the second discharge electrode pieces 125' are desirably formed of transparent conductive films such as Indium Tin Oxide (ITO) having higher optical transmitivity than metal and electrical conductivity.

At this time, the distance between the respective electrode pieces 115' and the distance between the respective electrode pieces 125' are 40 $\mu$m to 60 $\mu$m. Also, the distance between the first discharge electrode 115 and the second discharge electrode 125, i.e., the distance between the electrode pieces 115' and the electrode pieces 125' are 80 $\mu$m to 100 $\mu$m.

At this time, it is desirable that the distance between the respective electrode pieces 125' is 50 $\mu$m and the distance between the first discharge pieces 115' and the second discharge electrode pieces 125' is 90 $\mu$m.

As shown in FIG. 4, the discharge cell constituting the plasma display panel of the present invention includes a plurality of electrode pieces so that plasma discharge occurs in the center of the discharge cell. In other words, the discharge cell of the present invention includes a plurality of first discharge electrode pieces 115' and a plurality of second discharge electrode pieces 125'. Particularly, in one discharge cell, it is desirable that the number of the first discharge electrode pieces 115' and the number of the second discharge electrode pieces 125' are the same as each other. It is more desirable that one discharge cell includes a pair of first discharge electrode pieces 115' and a pair of second discharge electrode pieces 125'.

The operation of the plasma display panel according to the present invention will be described below.

If a discharge sustain voltage is applied to the first sustain electrode lines 110 and the second sustain electrode lines 120 from an external provided driving IC, the discharge sustain voltage is applied to the electrode pieces 115' of the first discharge electrode 115 through the first sustain electrode lines 110. The discharge sustain voltage is also applied to the electrode pieces 125' of the second discharge electrode 125 through the second sustain electrode lines 120.

Afterwards, discharge of the discharge cell is continuously maintained by potential difference between the potential of the first discharge electrode 115 and the potential of the second discharge electrode 125.

At this time, as shown in FIG. 4, since the discharge cell of the present invention includes a plurality of electrode pieces, plasma discharge 200 occurs in edges of the respective electrode pieces. In other words, since the largest potential difference occurs in the edges of the respective electrode pieces, electric field by the discharge sustain voltage converges on the edges of the electrode pieces 115' and 125' of the first and second discharge electrodes 115 and 125. For this reason, the plasma discharge 200 convergently occurs in the edges of the respective electrode pieces. Thus, the edges of the respective electrode pieces become an electric field convergence region 130.

Since the first discharge electrode 115 and the second discharge electrode 125 include a plurality of separate electrode pieces, respectively, each discharge cell includes separate electrode pieces. Therefore, wall charge does not leak in the adjacent cell, and thus error discharge does not occur.

As aforementioned, the plasma display panel according to the present invention has the following advantages.

Since the discharge cell includes a plurality of electrode pieces, it is possible to improve convergence of electric field. Also, since the discharge electrode can cut off a moving path of wall charge generated by the primary discharge, it is possible to reduce error discharge of the discharge cell, thereby improving discharge efficiency.

It will be apparent to those skilled in the art that various modifications and variations can be made in the plasma display panel according to the present invention without departing from the spirit or scope of the invention. Thus, it is intended that the present invention covers the modifications and variations of the invention provided they come within the scope of the appended claims and their equivalents.

What is claimed is:

1. A plasma display panel comprising:

a plurality of first sustain electrode lines successively formed on a substrate at a predetermined interval;

a plurality of second sustain electrode lines coupled with each of the first sustain electrode lines one by one;

a plurality of first discharge electrode pieces branched from each of the first sustain electrode lines; and a plurality of second discharge electrode pieces branched from each of the second sustain electrode lines, having discharge cells coupled with the first discharge electrode pieces.

2. The plasma display panel as claimed in claim 1, wherein at least one of each first sustain electrode line and each second sustain electrode line includes a metal.

3. The plasma display panel as claimed in claim 2, wherein the metal is formed of a three-layered film of Cr—Cu—Cr.

4. The plasma display panel as claimed in claim 1, wherein a distance between the first discharge electrode pieces adjacent to each other is in a range of 40 $\mu$m to 60 $\mu$m.

5. The plasma display panel as claimed in claim 4, wherein a distance between the first discharge electrode pieces adjacent to each other is 50 $\mu$m.

6. The plasma display panel as claimed in claim 1, wherein a distance between the second discharge electrode pieces adjacent to each other is in a range of 40 $\mu$m to 60 $\mu$m.

7. The plasma display panel as claimed in claim 6, wherein a distance between the second discharge electrode pieces is 50 $\mu$m.

8. The plasma display panel as claimed in claim 1, wherein the first discharge electrode piece and its corresponding second discharge electrode piece are spaced apart from each other at a distance of 80 $\mu$m to 100 $\mu$m.

9. The plasma display panel as claimed in claim 8, wherein the first discharge electrode piece and its corresponding second discharge electrode piece are spaced apart from each other at a distance of 90 $\mu$m.

10. The plasma display panel as claimed in claim 1, wherein one discharge cell includes a pair of the first discharge electrode pieces and a pair of second discharge electrode pieces.

11. The plasma display panel as claimed in claim 1, wherein at least one of the first discharge electrode and the second discharge electrode includes a transparent conductive film.

12. The plasma display panel as claimed in claim 1, wherein each of the second discharge electrode pieces is formed to couple with each of the first discharge electrode pieces.

* * * * *